US005573076A

United States Patent [19]

McCannon, Jr.

[11] Patent Number: 5,573,076

[45] Date of Patent: Nov. 12, 1996

[54] AUTOMATED DRILL

[76] Inventor: W. A. McCannon, Jr., 2168 Jaudon Rd., Elberton, Ga. 30635

[21] Appl. No.: 492,402

[22] Filed: Jun. 19, 1995

[51] Int. Cl.[6] ..... F21B 44/00

[52] U.S. Cl. ..... 175/24; 175/40; 173/28

[58] Field of Search ..... 175/24, 40, 45; 173/28, 42, 46

[56] References Cited

U.S. PATENT DOCUMENTS

| | | | |
|---|---|---|---|
| 2,041,690 | 5/1936 | Baumeister et al. | 255/50 |
| 3,045,769 | 7/1962 | Faucht et al. | 175/211 |
| 3,637,318 | 1/1972 | Hayes | 408/11 |
| 3,639,071 | 2/1972 | Breitkopf et al. | 408/91 |
| 4,157,231 | 6/1979 | Phillips | 408/1 R |
| 4,246,973 | 1/1981 | Moyer | 173/8 |
| 4,380,842 | 4/1983 | Thomas | 15/304 |
| 4,589,499 | 5/1986 | Behrens | 173/22 |
| 4,601,000 | 7/1986 | Montabert | 173/11 |
| 4,639,868 | 1/1987 | Tanaka et al. | 364/420 |
| 4,809,788 | 3/1989 | Nelson | 173/28 |
| 5,181,934 | 1/1993 | Stolarczyk | 299/1.2 |
| 5,301,594 | 4/1993 | Argazzi et al. | 86/50 |

*Primary Examiner*—Frank Tsay

[57] ABSTRACT

A device for and a method of automatically drilling a selected number of longitudinally spaced holes to a depth of up to twelve feet during an uninterrupted operation in a mineral surface usually granite. The device includes a support frame carrying a drill assembly for vertical and longitudinal movement. The drill assembly comprises a carriage, a mast and a housing which mounts at least one drill carrying a drill steel or rod. A programmable computer controls a plurality of drives to move the drill assembly from a raised position into a drilling position adjacent a desired surface. The programmable computer then activates the drill to drill a hole of a prescribed depth after which it deactivates the drill. The drives are now activated to retract the drill assembly and to return it to it's raised position. The programmable computer then controls the drive to index the drill assembly along the support frame into a successive drilling position. The programmable computer then lowers the drill assembly to the drilling position and the above drilling sequences are repeated. The devices repeat this process until the desired number of holes are drilled.

30 Claims, 6 Drawing Sheets

AUTOMATED DRILL

BACKGROUND OF THE INVENTION

This invention relates to a drill assembly which maybe set in position and actuated to sequentially drill a plurality of laterally spaced holes along a single longitudinal axis automatically. The drill assembly is also capable of drilling these holes to a depth of between 11 feet and 13 feet using only one drill steel or rod. The drill assembly is primarily designed for use with stone, however, it's application is not confined to these materials.

In the process of quarrying granite blocks, which are generally rectangular with vertical and transverse dimensions of approximately 3 feet and a longitudinal dimension of at least 5 feet, the granite floor must first be broken into ledges. Each ledge will produce from ten to fifty blocks. Drills are used to break the blocks from the ledges. In the past this has been a slow, labor intensive process.

The drills now in use are manually operated, will drill only one or two holes from one set-up and will operate initially with no more than a 4 foot drill rod. These limitations require that the drill rod be changed during the process of drilling of 11 foot to 13 foot holes. It also requires that the drill assembly be moved and re-set after each hole is drilled.

It is an object of the instant invention to overcome these drilling limitations by providing a drill which will automatically and successively drill a plurality of spaced holes.

It is a further object of the invention to provide a drill assembly which operates in a dust free manner.

It is a further object of the invention to provide a drill assembly capable of being set up level quickly.

It is a further object of the invention to provide a drill assembly which operates without supervision.

It is a further object of the invention to provide a drill capable of operating initially with drill rods of up to 14 feet.

It is another object of the invention to provide an assembly which drills holes into granite at a high rate of speed.

It is a further object of the invention to control drilling of a drill assembly with a programmable computer.

SUMMARY OF THE INVENTION

The above objectives are accomplished according to the present invention by a method of automatically drilling a selected number of longitudinally spaced holes in a mineral surface, usually granite and usually the floor surface of a granite quarry. The method consists of providing a support frame carrying a drill assembly for vertical and longitudinal movement. The drill assembly includes a carriage, a mast and a housing carrying a drill with a drill rod or steel. The support frame is positioned over the mineral surface and the drill assembly is moved from a raised position into a drilling position. Upon reaching the drilling position the drill is automatically activated to drill a hole of prescribed depth. Upon reaching the prescribed depth, the drill is deactivated. The drill assembly is then activated to retract the drill and to return to the raised position. The drill assembly is then indexed along the support frame into an adjacent position over the mineral surface and the above drilling sequence is repeated until the selected number of holes have been drilled.

The method includes providing a hydraulic drive for moving the drill assembly and electronic controls to control the hydraulic drive.

The method includes the act of drilling the holes to a depth of at least 10 feet before retracting the drill.

The method includes controlling the rate of drilling by positively driving the drills downward during drilling.

The method includes providing a housing with a pair of longitudinally spaced drills and causing the carriage to index a distance substantially equal to twice the spacing between the pair of drills.

The method includes providing the drill assembly with a moveable drill steel guide which is positioned at the approximate midpoint of the drill steel during initial drilling. The drill steel guide acts to maintain the drill steel stable.

An automatic drilling apparatus including a drilling assembly, a control assembly and a support assembly carrying the drill assembly and the control assembly. The control assembly includes a hydraulic pump and hydraulic drives, which are connected through a first valve group, for moving the drilling assembly in horizontal and vertical directions. The control assembly also includes a pneumatic supply for powering the drills of the drilling assembly. A second valve is provided to control the pneumatic supply. An electronic control, i.e. a programmable computer, is connected with the first valve group and second valve and is operable to be controlled to selectively actuate the first valve group and the second valve to cause the drilling assembly to automatically and sequentially move from an inactive position into a drilling position where drilling is carried out, to return to the inactive position and to then move to laterally spaced successive drilling positions where drilling is again carried out. The sequence of operations is repeated until a desired number of laterally spaced holes are drilled.

The drilling apparatus includes a support frame having vertically adjustable legs which allow the drilling apparatus to be leveled prior to drilling. Each leg of the support frame comprises a hydraulic cylinder and piston connected with an individual pneumatic control. The pneumatic controls allow each piston to be positioned at a desired longitudinal extension which brings level the support frame. The support assembly includes a track which supports the drilling assembly for movement and a platform which supports the control assembly.

The drilling assembly comprises a carriage, a mast and a housing carrying the drill. The carriage carries the mast for vertical movement and the mast carries the housing for vertical movement. The carriage is carried by a track formed on the support frame for transverse movement. The mast includes a pair of spaced rails which carry the housing for longitudinal movement over the mast. A drive motor is connected with the housing and is operative to positively drive the housing in each direction over the mast.

The housing carries a pair of pneumatic drills each having a drill steel or rod of between 11 feet and 14 feet. A drill steel guide is arranged at about the mid point of each drill steel and functions to support and guide the drill steel during initial drilling.

An electronic control, preferably a program computer is connected with a plurality of drive motors which move the drill assembly through a plurality of valves and a hydraulic pump. A plurality of limit switches are provided to activate the programmable computer which then activates the drills when the drilling position is achieved, to deactivate the drills when drilling is complete, to return the drilling assembly to an inactive position over the drilled holes, to index the drilling assembly transversely of the drilled holes, to return it to the drilling position and to reactivate the drills. The programmable computer repeats this sequence automatically until a selected number of holes have been drilled.

The control assembly includes a manual control unit having an override switch and a plurality of manual switches which are capable of overriding the programmable computer and controlling the device manually.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
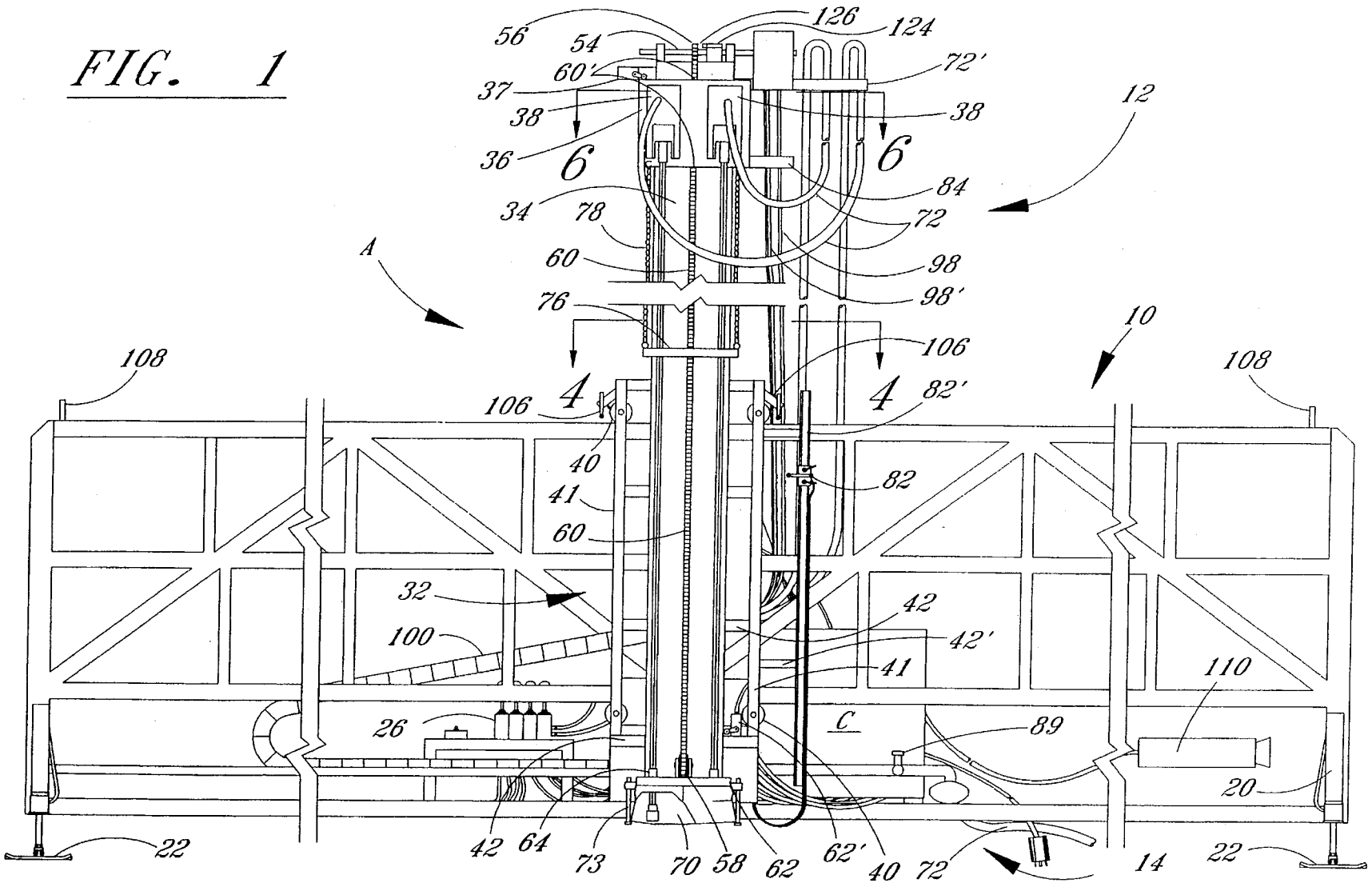
FIG. 1 is a front view of the drill assembly of the invention.

Referring now to the drawings, the invention will now be described in more detail.

Figure 2:
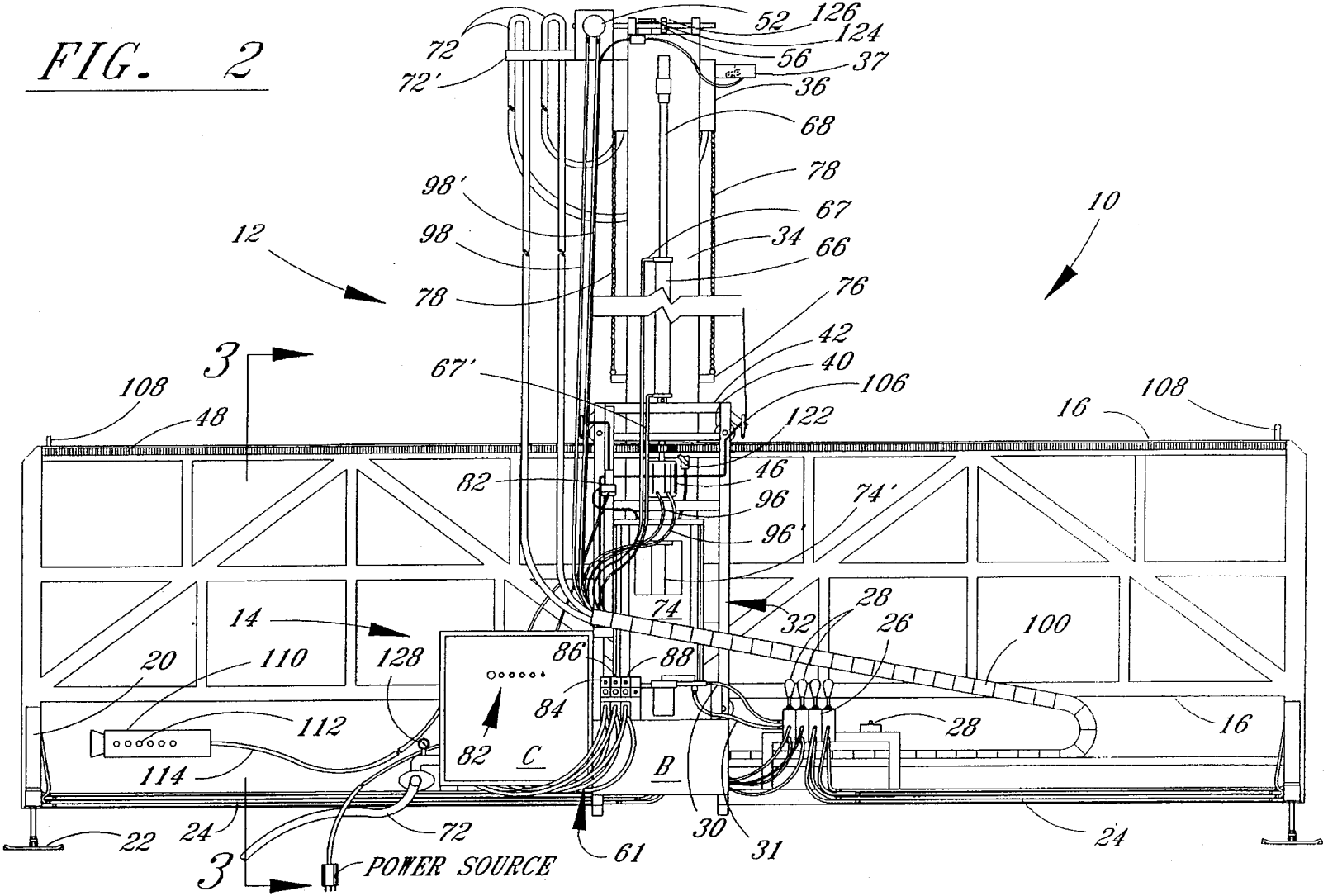
FIG. 2 is a rear view of the drill assembly of the invention.
Figure 3:
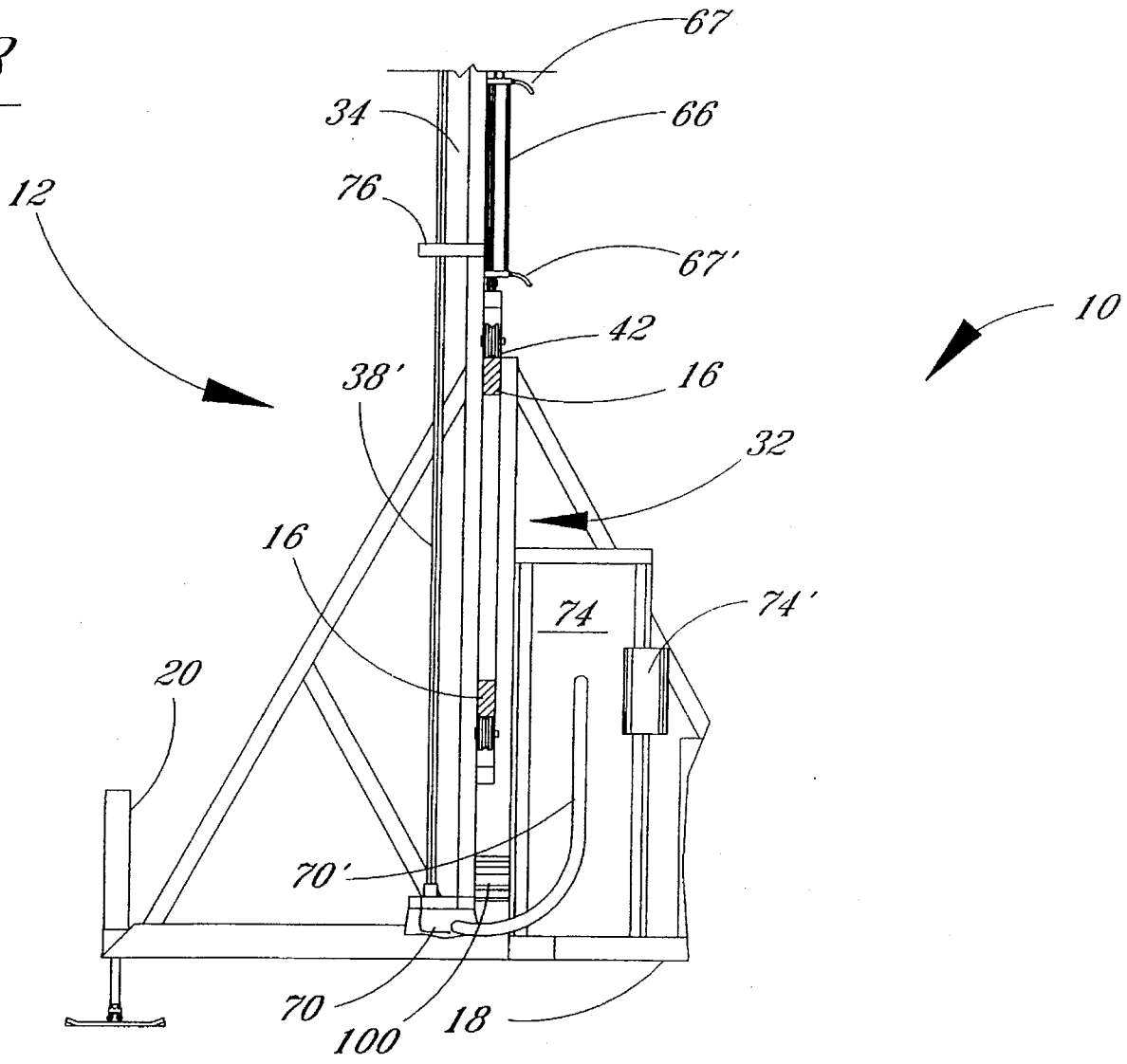
FIG. 3 is a sectional side view of the drill assembly of the invention.

FIGS. 1–3 show automatic drilling device A of the invention. A support assembly 10 carries a drilling assembly 12 for transverse movement, the motion being dictated by a control assembly 14.

The support assembly 10 includes a support frame having vertically spaced rails 16 supported by a platform 18 which is arranged transversely of the rails. Each of the four corners of platform 18 mounts an adjustable leg, each comprising a hydraulic cylinder/piston assembly 20. The exposed end of each piston of assembly 20 mounts a support plate 22. Each cylinder of piston assembly 20 is connected with hydraulic lines 24 connected at its opposite ends. Pairs of lines 24 are connected with a control valve 26 of a control assembly. Each control valve 26 is provided with a control lever 28. Hydraulic fluid is supplied to control valves 26 by line 30 from hydraulic pump B and is returned to the hydraulic pump by line 31.

The automatic drilling device A is designed primarily for drilling stone. The surfaces over which it operates are seldom, if ever, level. Consequently, support assembly 10 is provided with the leveling mechanism just described in order that the drilling assembly may be positioned with its mast 34 positioned at true vertical for drilling. In practice, drilling device A is lowered or placed in position over the surface to be drilled. The operator, using levers 28, individually adjusts cylinder/pistons 20 to bring the extension or exposed length carrying pad 22 into a desired position. There is a level bubble 28' arranged adjacent control valves 26 which indicates when the frame is level. When support frame 10 is made level, drilling assembly 12 is ready to be positioned for drilling.

Drilling assembly 12 includes carriage 32 which mounts a mast 34, and a drill housing 36 carrying a pair of pneumatic drill heads 38. It is noted that the drill heads may be hydraulically driven if desired.

Carriage 32 is a rectangular shaped frame having four support rollers 40 arranged on spaced vertical arms 41 and positioned to support the carriage on upper and lower rails 16 for transverse movement across support frame 10. A plurality of horizontal arms 42 are spaced along the length of vertical arms 41 and are connected therewith. Arms 42 are parallel with each other and with rails 16.

Carriage 32 is driven across frame by a hydraulic motor 46 whose drive pinion meshes with rack 48 formed along a side surface of upper rail 16. Motor 46, which is mounted on rails 42 is connected with and driven by hydraulic pump B through lines 96, 96'.

Figure 4:
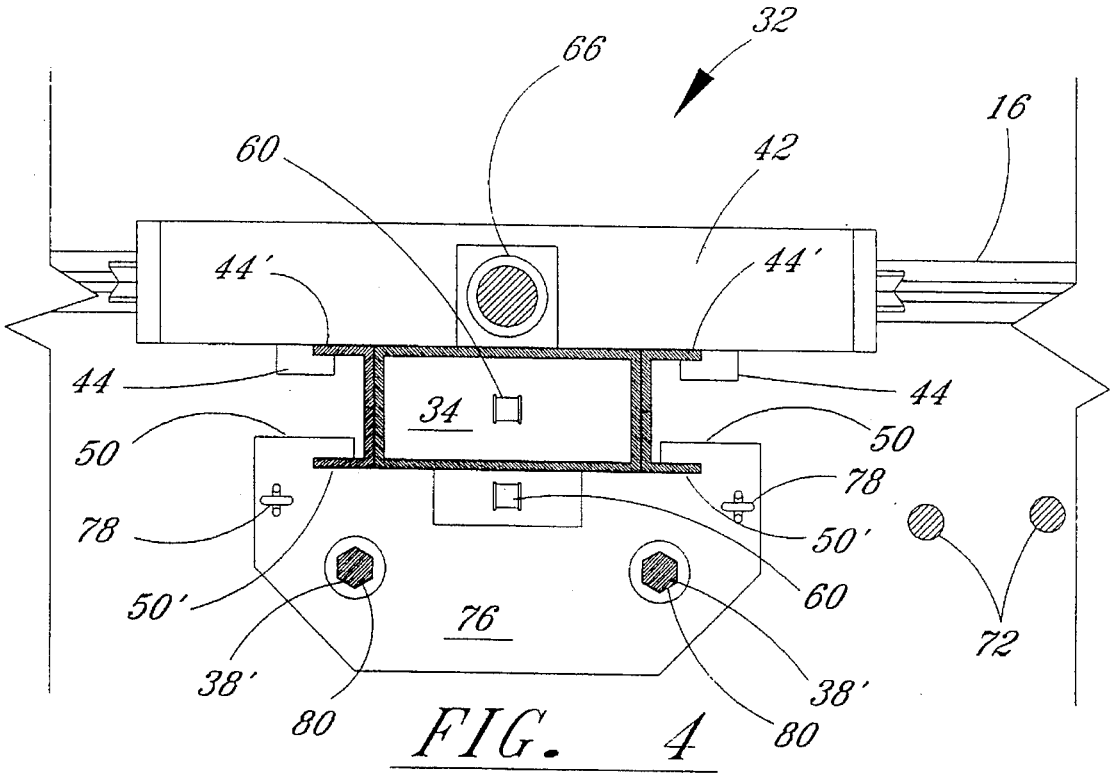
FIG. 4 is a top sectional view taken along line 4—4 of FIG. 1.
Figure 6:
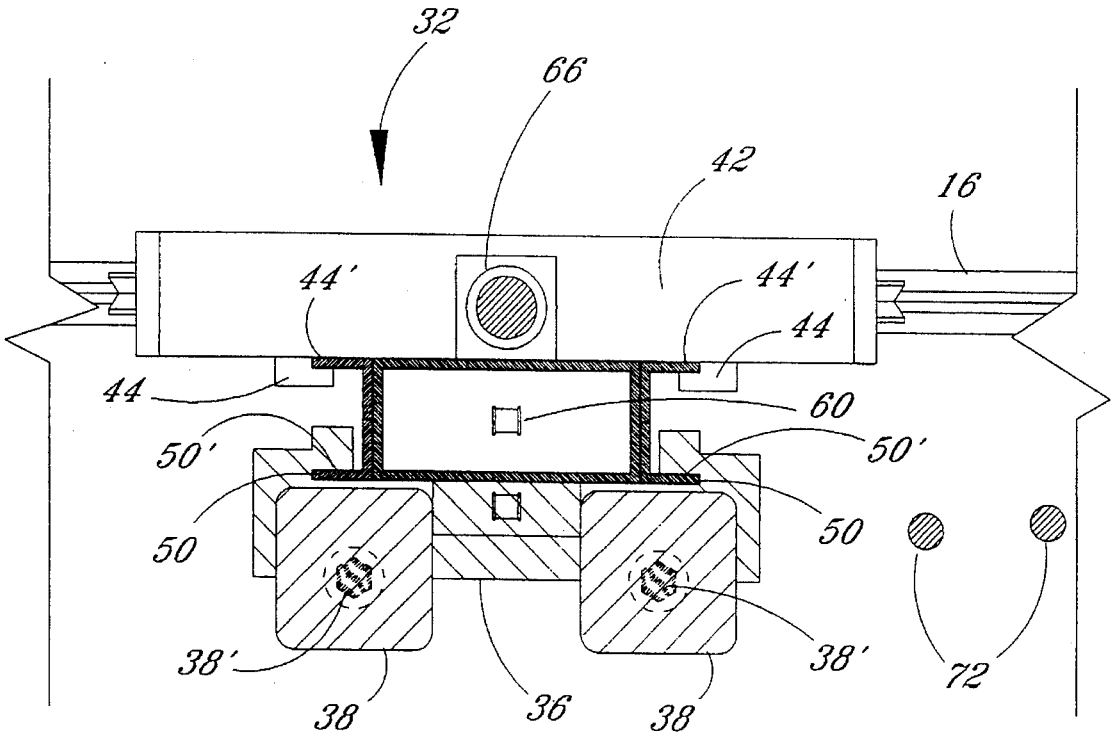
FIG. 6 is a top sectional view taken along line 6—6 of FIG. 1.

As best seen in FIGS. 4 and 6, a vertical guide 44 is secured on the outer face of carriage 32 intermediate of arms 41. Guide 44, which comprises a pair of U-shaped slots, is adapted to carry mast 34 for vertical movement.

Mast 34, which is shaped essentially as an I beam, includes a pair of outer edges 44' on one side which are engaged in U-shaped guide members 44 while outer edges 50' of the other side engage in guides 50 of drill housing 36 and allow independent vertical movement of the housing along mast 34.

Formed on the upper end of mast 34 is a drill housing drive unit comprising hydraulic motor 52 having a drive shaft 54 carrying a sprocket 56. Mounted adjacent the lower end of mast 34 is a second sprocket 58. A drive chain 60 is connected at its opposite ends 60' with the upper and lower sides of housing 36 to form a continuous loop. Chain 60 engages with sprockets 56 and 58 as it passes around opposed ends of mast 34 and through the opening formed by the outer faces of the mast. Rotation of shaft 54 by motor 52 positively moves housing 36 vertically along the length of the mast 34.

Figure 5:
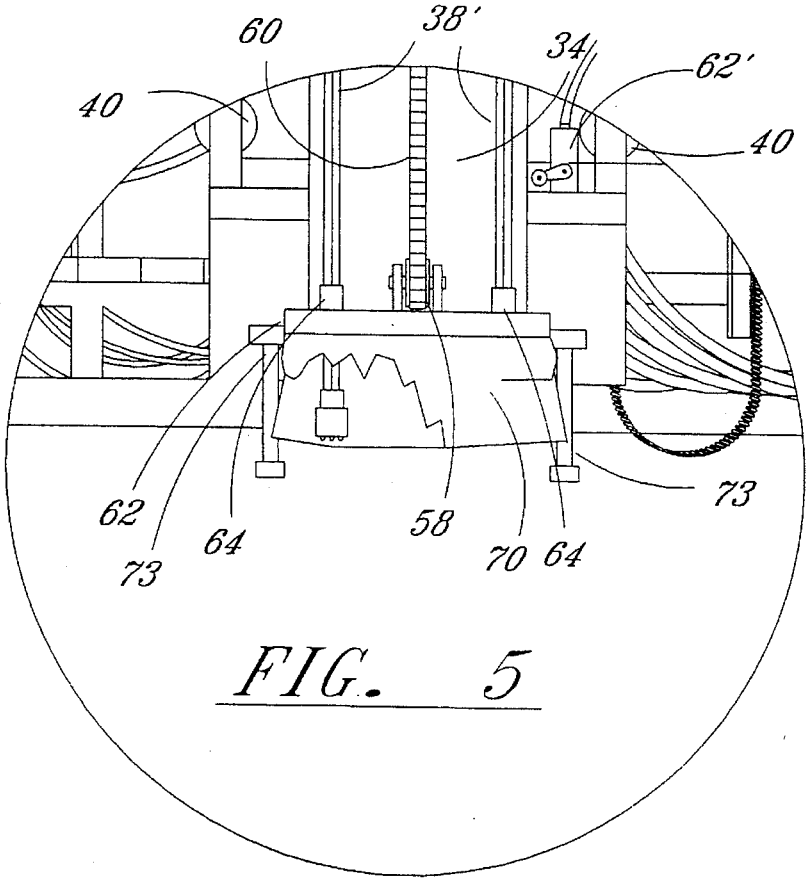
FIG. 5 is an enlarged sectional view showing the foot assembly of the drilling assembly.

As best seen in FIGS. 1 and 5, the lower end of mast 34 comprises foot 62 which extends perpendicular relative to the longitudinal axis of mast 34. A pair of drill steel or rod guide holes 64 are formed in foot 62. Guide holes 64 are spaced at between 6"and 12"and are adapted to receive the lower ends of drill steel or rods 38' which extend from housing 36 and are carried by drill heads 38. Guide holes 64 act to space and guide drill steel 38' during drilling.

Turning now to FIGS. 2 and 3, a hydraulic cylinder 66 carrying a piston 68 is mounted at one end with carriage 32 and on its opposite end with the rear side of mast 34 adjacent to its upper end. Hydraulic fluid is supplied to the cylinder 66 via lines 67, 67' which are connected at their opposite ends with hydraulic valve 86. The cylinder 66 is operative to reciprocate piston 68 and thereby vertically move and control the vertical position of mast 34. Electronic control C which is a programmable computer controls valve 86.

An exhaust system, best shown in FIGS. 1, 3, and 5, is arranged at the lower end of mast 34. This system includes a skirt 70 secured to foot 62. A suction hose 70' which is attached to skirt 70 to connect with the interior area surrounding drill steels 38'. Hose 70' also connects with collection barrel 74. Vacuum motor 74' creates a suction through hose 70' between the interior of skirt 70 and barrel 74 so that dust created during drilling is drawn out of the drill area and deposited in barrel 74. This exhaust system is commercially available and is of itself not a part of this invention.

Mounted adjacent the lower end and on opposite sides of mast 34 are a pair of switches 73 the end portions of which extend below foot 62. Switches 73 are connected with electronic control C through appropriate leads. Switches 73 which are open or inoperative when mast 34 is raised, are designed to close or become active when mast 34 is lowered to the drilling position. In this position the switches strike the surface to be drilled and are raised or closed. When closed, switches 73 signal electronic control C to cause valve 86 to lock cylinder/piston 66, 68 in position. Also, switch 73 activates the electronic control C to control valve 88 and 89 to actuate drills 38 and motor 52.

Positioned on carriage 32 adjacent to mast 34 is limit switch 62' which is also connected with electronic control C. Limit switch 62' is arranged to engage with foot 62 when mast 34 is raised to its upper limit. Limit switch 62' when engaged, signals electronic control C to stop hydraulic movement to cylinder 66 by controlling valve 86. This operation will be discussed in more detail further on.

Mounted adjacent the upper end of mast 34 is limit switch 37 which connects with electronic control C. Also, mounted on shaft 54 is a gear 126 and a gear teeth counting sensor 124 which is also connected with electronic control C. Limit switch 37 functions to signal electronic control C to deactivate motor 52 when housing 36 has been raised to its upper limit. Sensor 124 functions to monitor movement of housing 36, either upward or downward. Should this movement stop before housing 36 reaches either of its limits, sensor 124 signals electronic control C of a malfunction and the device is shut down.

Drill housing 36 carries a pair of pneumatic drills 38 which each mount a drill steel or rod 38' which is between 11 feet and 14 feet long. A drill steel or rod guide 76, best seen in FIG. 1 and 4 is connected to the lower edge of housing 36 with a pair of flexible cords or chains 78. Guide 76 which comprises a rectangular block in which a pair of spaced slots 50 are formed. Outer edges 50' of mast 34 are engaged in slot 50 and act to maintain guide 76 in a fixed position relative to the longitudinal axis of mast 34. A pair of slots 80 are formed in guide 76 and are aligned with guide holes 64 and drills 38. Slots 80 are shaped to conform with the outer contour of drill steel or rods 38'. Chains 78 are of a length which positions guide 76 to be at approximately the midpoint of drill rods 38' prior to and during the initiation of drilling.

Guide 76 functions to provide stability for drill rods 38' during the initial drilling operation. By maintaining rods 38' stable and vertically aligned between guide holes 64 slots 80 and drills 38, the drill rods are controlled to drill continuous parallel and vertical holes.

As drilling proceeds and housing 36 is lowered by as much as 13 feet down mast 34, guide 76 is also lowered while maintaining its spaced position from the housing. This relationship continues until guide 76 contacts the upper surface of foot 62 after the housing has been lowered about 6 feet. Now guide 76 comes to rest. The flexible supports 78 simply accumulate about foot 62 while housing 36 continues it's downward movement along mast 34.

In the past, it was not possible to initiate drilling with drill rods over 7 feet long because they would flex along their length at approximately their midpoint. This would misalign them and prevent them from drilling vertical and parallel holes. Drilling holes of 11 feet or more was carried out by first drilling 6 foot holes, stopping the drilling operation and withdrawing the drill rod. The 6 foot drill rods were then replaced with 12 foot drill rods and drilling was resumed to drill the remainder of the hole. This practice was extremely time consuming. By providing guide 76, the drill rods are stabilized which allows drilling of 11 foot holes to be accomplished in one operation.

Mounted on a vertical arm 41 of carriage 32 is control switch 82. This switch is mounted for vertical adjustment along a vertical sleeve 82' carried on arm 41 and is operative to signal electronic control C to stop the drilling operation once started and to retract housing 36 and mast 34 to their raised position. During drilling, drill housing 36 descends along mast 34. When housing 36 comes into the vicinity of switch 82, arm 84 actuates the switch signalling the electronic control C to stop drilling. Actuation of switch 82 also signals the electronic control to sequence the drilling operation as will be described later. By moving switch 82 vertically along sleeve 82' the depth of drilling can be controlled.

Control assembly 14 comprises an electronic control C, a hydraulic pump B, and control valves 84, 86, 88 and 89. The electronic control C comprises a programmable computer which includes the usual control setting buttons 82 and utilizes a program to bring about the desired functions. Both the hydraulic pump B and the electronic control C are commercially available and of themselves form no part of this invention. A Telemecanique TSx17 computer is preferred, however any model capable of controlling the drilling assembly is acceptable.

Control valves 84, 86, and 88 are connected with hydraulic pump B by suitable feed lines and return lines 61. Control valve 84 and 88 are connected with hydraulic motors 46, 52 via lines 96, 98 and return lines 96',98'. Cylinder 66 is connected with control valve 86 by lines 67, 67'. Control valves 84, 86 and 88 are two way valves controlled by electronic control C through appropriate leads.

Valve 89 which is controlled by electronic control C, is connected with pneumatic supply line 72 which also with the hydraulic jacks 38. Lines 72 are carried for movement with housing 36 by a support rod 72' carried by the housing 36. Valve 89 is a two way valve controlled by electronic control C by suitable leads.

As can be seen in FIGS. 1 and 3, a hollow flexible shield 100 is provided to collect and protect pneumatic lines 73 and hydraulic lines 67, 67', 98, 98' and 96, 96' as they lead from the respective valves to which they are connected and extend to the respective devices which they drive. These pneumatic and hydraulic lines must be long enough to accommodate movement of the drilling assembly 12 across the support assembly 10. Shield 10, which is commercially available, comprises a plurality of C shaped elements pivotally connected together and of sufficient size to house all of the above hoses.

A pair of limit switches 106 are mounted on opposite edges of carriage 32. These switches are adapted to limit movement of carriage 32 over rails 16 by contacting stops 108 which signal electronic control C to deactivate the device. Stops 108 may be adjustably positioned along upper rail 16.

A sensor 122 is mounted on carriage 32 in position to sense or count the teeth of the drive gear of motor 46. When motor 46 is activated by electronic control C to index drilling assembly 12 along frame 10, sensor 122 counts the gear teeth. When a selected member has passed, the sensor signals electronic control C which deactivates motor 46 via valve 84.

Figure 7:
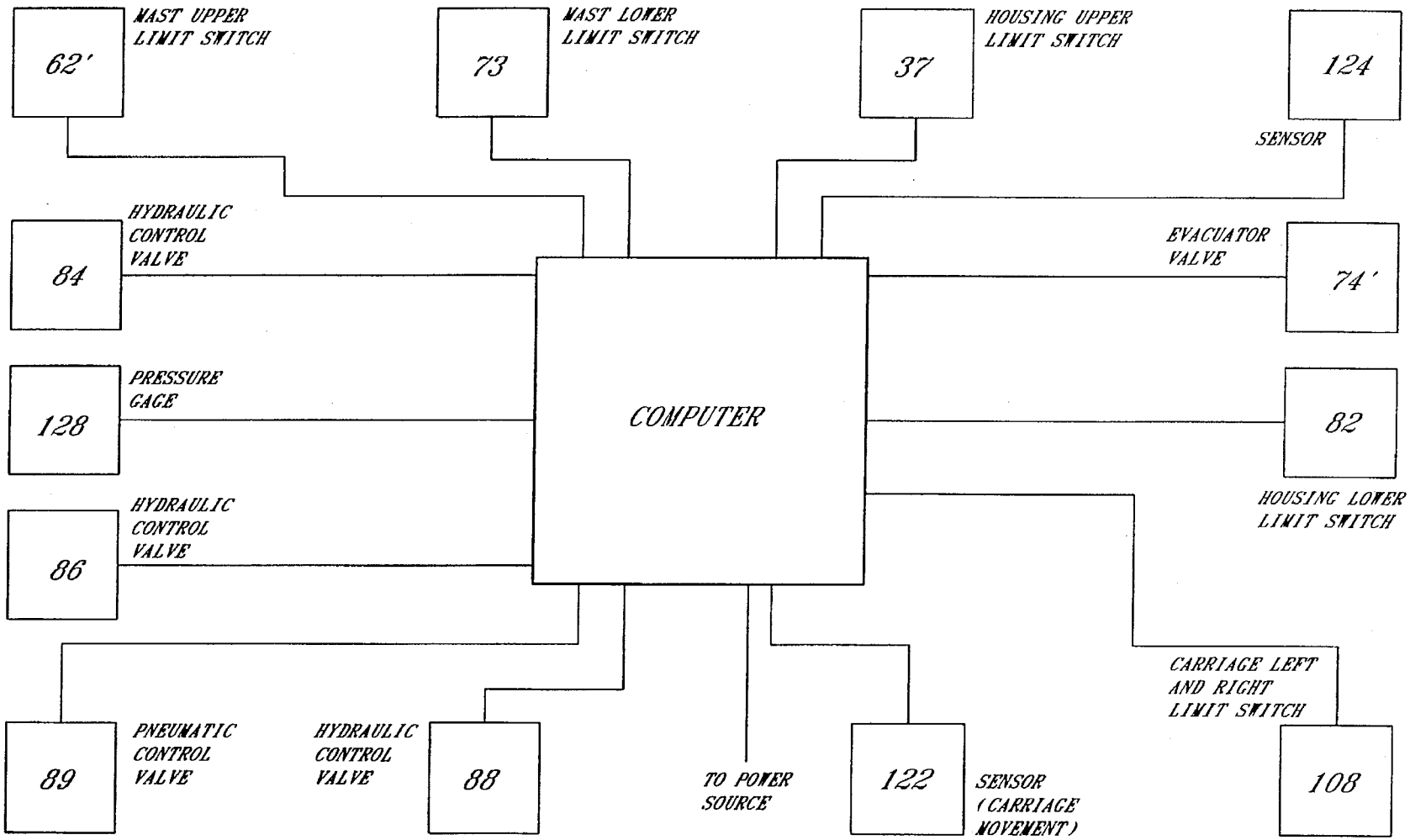
FIG. 7 is a block diagram showing the limit switches connected with the program computer.

Turning now to FIG. 7, a diagram of the limit switches, the sensors and the control valves all connected with the programmable computer is shown. An upper limit switch 62' which is activated and signals electronic control or computer C when mast 34 has reached its upper limit activates the computer to stop movement of piston 66/68 through valve 86. Likewise limit switch 73 activates the computer to control valve 86 to stop piston 66/68 and to actuate drills 38 through valve 89, to actuate suction motor 74' and to actuate motor 52 to lower housing 36 through valve 88.

Limit switch 82, when actuated signals electronic control C which acts to control valve 89 to deactivate drills 38, to control valve 88 to reverse motor 52 to raise housing 36, to deactivate suction motor 74' and to activate through valve 86 piston 66/68 to raise mast 34. Limit switch 37, when contacted, signals electronic control C which acts to control valve 88 to deactivate motor 52 as housing 36 is at its upper limit and to control valve 84 to activate motor 46 to index carriage 32.

Sensor 122 monitors movement of carriage 32 by counting the rotating teeth of motor 46. When a sufficient number of teeth have been counted, carriage 32 has moved a desired distance and sensor 122 signals electronic control C which acts to deactivate motor 46. Electronic control C then activates piston 66/68 through valve 86 to again lower mast 34.

Safety devices comprise sensor 124 which monitors movement of housing 36 and gauge 128 which monitors pneumatic pressure. Should housing 36 stop moving prior to its reaching limit switch 82, electronic control C is signaled and the drilling device is shut down. Likewise, should pneumatic pressure fall below a set limit, usually 80 psi, the electronic control C is signaled and the drilling device is shut down.

In use, support assembly 10 is placed in a desired position on the floor of a stone quarry and leveled by using controls 26 to regulate the length of the pistons of cylinders 20. The drilling assembly 12 is positioned adjacent one end of support frame 10 and stops 108 are located at desired positions. The electronic control C is activated by an appropriate control button 82. Valve 86 is opened to allow hydraulic fluid to the upper side of hydraulic cylinder 66 which causes the motor to begin lowering mast 34. When mast 34 reaches the proper position relative to the quarry floor, switch 73 is raised and activated which signals electronic control C which then acts to close valve 86 and to open valve 89 connecting drill head 38 with pneumatic pressure through lines 72. The drill heads 38 are activated by pneumatic pressure of approximately 90 psi and drilling begins. Valve 88 is operated to actuate hydraulic motor 52 which begins moving housing 36 in a downward direction. It is noted that drilling speed can be increased or decreased by controlling the rate of descent of housing 36 by hydraulic motor 52. Normally motor 52 drives drill heads 38 downward at a rate to drill at 4 feet per minute. Vacuum motor 74' is also actuated to provide suction within the interior of curtain 70 which collects and draws off the stone dust formed during drilling.

As housing 36 continues to move down mast 34 guide 76 moves simultaneously therewith down the mast until it engages with and comes to rest on base 62. At this point housing 36 moves alone toward foot 62. When housing 36 reaches a selected low position, rod 84 engages with switch 82. The selected position is the point at which the desired depth has been drilled.

Switch 82, when contacted, signals electronic control C which closes valve 89 which stops drilling by discontinuing the supply of pneumatic air to drills 38. Electronic control C also controls valves 88 and 86 to reverse positions which delivers hydraulic fluid to the lower end of cylinder 66 and in the opposite direction to motor 52. Piston 60 is now moved in a direction to raise mast 34 and motor 52 rotated in a direction to raise housing 38 drawing the drill rods 38' out of the drilled holes and the drill assembly to its raised position.

When mast 34 engages with limit switch 62' and housing 38 engages with limit switch 37, electronic control C closes valves 88 and 86 to stop upward movement of the drilling assembly. Valve 84 is opened to actuate motor 46 which moves or indexes carriage 32 a prescribed distance in one direction over rails 16. This distance which is normally twice the distance between drill rods 38' to provide equally spaced and parallel holes is controlled by sensor 122 which signals electronic control C to close valve 88.

After indexing, electronic control C again opens valve 86 to lower mast 34 toward the surface of the quarry floor. Again, switch 73 is raised, movement of mast 34 is stopped, and drilling begins again.

The above sequence is repeated again and again until limit switch 106 strikes stop 108 at which point the device is shut down.

A manual control 110 is connected with electronic control C by lead 114. Manual control 110 includes a plurality of switches 112 which are capable of over riding the automatic functions of electronic control C and of manually controlling valves 84, 86, 88 and 89 to manually control any segment of the drilling operation when desired.

While a preferred embodiment of the invention has been described using specific terms, such description is for illustrative purposes only, and it is to be understood that changes and variations may be made without departing from the spirit or scope of the following claims.

What is claimed is:

1. A method of automatically drilling a selected number of longitudinally spaced holes in a mineral surface comprising:

(a) providing a support frame carrying a drill assembly for vertical and longitudinal movement, said drill assembly including at least one drill carrying a drill steel;

(b) positioning said support frame over said mineral surface;

(c) moving said drill assembly from a raised position into a drilling position adjacent said surface;

(d) activating said drill to drill a hole of prescribed depth and deactivating said drill upon completion of drilling said hole;

(e) activating said drill assembly to retract said drill and to return to said raised position;

(f) indexing said drill assembly along said support frame; and, (g) repeating steps c–f until said selected number of holes have been drilled.

2. The method of claim 1 including providing hydraulic drives for moving said drill assembly.

3. The method of claim 2 including providing electronic controls to control said hydraulic drives.

4. The method of claim 1 including drilling said holes to a depth of at least 10 feet before retracting said drill.

5. The method of claim 1 including collecting and removing any dust generated during drilling.

6. The method of claim 1 wherein said drilling assembly includes a mast and mounting said mast on a carriage and moving said mast vertically on said carriage during movement of said drill assembly to said drilling position.

7. The method of claim 6 wherein said drilling assembly includes a housing carrying said drill and mounting said housing on said mast and moving said housing vertically along said mast during drilling.

8. The method of claim 1 including controlling the rate of drilling by positively driving said drill downward during drilling.

9. The method of claim 7 including providing said housing with a pair of longitudinally spaced drills.

10. The method of claim 9 causing said drill assembly to index a distance substantially equal twice the spacing between said pair of drills.

11. The method of claim 1 including providing said drill assembly with a drill steel guide and causing said drill steel to pass through said guide.

12. The method of claim 11 including locating said drill steel guide at the approximate midpoint of said drill steel during initial drilling to maintain said drill steel stable.

13. An automatic drilling apparatus including a drilling assembly, a control assembly and a support assembly carrying said drilling assembly and said control assembly;

said control assembly including a hydraulic pump connected through a first valve group with drives for individually moving said drilling assembly along horizontal and vertical axes;

said control assembly further including a pneumatic supply for powering drills of said drilling assembly and a second valve controlling delivery of said pneumatic supply;

said control assembly further including a programmed electronic control connected with said first valve group and said second valve;

a plurality of switches carried by said drilling assembly and connected with said electronic control, said switches functioning to signal said electronic control to selectively actuate said first valve group and said second valve, whereby said drilling assembly is automatically and sequentially moved from an inactive position into a drilling position, returned to said inactive position and moved to a laterally spaced drilling position with drilling to a selected depth being carried out when said drilling assembly is in said drilling position.

14. An automatic drilling apparatus comprising a support assembly, a drilling assembly and a control assembly; wherein, said support assembly includes a support frame adapted to support said drilling assembly for vertical and horizontal movement;

said drilling assembly includes at least one drill and a plurality of drive motors for moving said drill of said drilling assembly vertically and horizontally;

said control assembly including a programmable computer adapted to automatically and selectively actuate and deactivate said drive motors to move said drill of said drill assembly vertically and horizontally over preselected distances and to automatically actuate and de-actuate said drill; whereby, said drilling apparatus is operative to automatically and sequentially drill a plurality of holes of selected depth along a longitudinal axis.

15. The apparatus of claim 14 wherein said support frame includes vertically adjustable legs whereby said drilling apparatus may be leveled prior to drilling.

16. The apparatus of claim 15 wherein each said leg comprise a hydraulic cylinder and piston connected with an individual pneumatic control whereby each piston may be positioned at a desired longitudinal extension to level said support frame.

17. The apparatus of claim 14 wherein said support assembly includes a track supporting said drilling assembly for movement and a platform stationarily supporting said control assembly.

18. The apparatus of claim 14 wherein said drilling assembly comprises a carriage, a mast and a housing carrying said drill, said carriage carrying said mast for vertical movement and said mast carrying said housing for vertical movement.

19. The apparatus of claim 18 wherein said support frame includes a track carrying said carriage for transverse movement over said support frame, and one of said plurality of drive motors comprising a hydraulic motor carried by said carriage;

said control assembly controlling said hydraulic motor between an operative and an inoperative condition, said hydraulic motor being operative to lock said carriage in position on said track when in said inoperative condition and to move said carriage along said track and over said support frame when in said operative condition.

20. The apparatus of claim 18 wherein said mast includes a pair of spaced edges, said edges being adapted to carry said housing for longitudinal movement over said mast, and a second of said plurality of drive motors being connected with said housing, said second drive motor being operative to positively drive said housing in each direction.

21. The apparatus of claim 20 wherein said second drive motor is controlled between an operative condition and an inoperative condition by said programmable computer.

22. The apparatus of claim 18 wherein said plurality of drive motors includes a third drive motor, said third drive motor being connected with said carriage and said mast and being operative to move said mast vertically relative to said carriage.

23. The apparatus of claim 22 wherein said third drive motor comprises a hydraulic cylinder and piston carried by said mast and said carriage, said cylinder and piston being operative to reciprocally move said mast relative to said carriage.

24. The apparatus of claim 23 wherein said control assembly includes a valve controlling delivery of hydraulic fluid to said cylinder, said programmable computer being operative to control said valve; whereby, said mast is raised, lowered or held stationary by said cylinder and piston.

25. The apparatus of claim 18 wherein said housing carries a pair of pneumatic drills each carrying a drill steel of at least 11 feet.

26. The apparatus of claim 25 wherein said housing carries a guide, said guide being adapted to receive, to support and to guide said drill steel at approximately its mid-point during initiation of drilling.

27. The apparatus of claim 18 wherein said carriage includes a control switch mounted for vertical adjustment, said control switch being operative to signal said programmable computer when the desired depth is drilled.

28. The apparatus of claim 27 wherein upon activation of said control switch, said programmable computer acts to deactivate said drill, to raise said housing along said mast, to raise said mast along said carriage, to index said carriage, and to lower said mast.

29. The apparatus of claim 18 wherein said drilling assembly includes an evacuator assembly comprising a curtain and an evacuator hose arranged adjacent a lower end of said mast, said evacuator assembly being operative to remove dust created by drilling.

30. The apparatus of claim 14 wherein said control assembly includes a manual control unit, said manual control unit having a plurality of manual switches capable of overriding said programmable computer so that said drilling apparatus may be manually controlled.

* * * * *